US005359313A

United States Patent [19]

Watanabe et al.

[11] Patent Number: 5,359,313

[45] Date of Patent: Oct. 25, 1994

[54] STEP-UP TRANSFORMER

[75] Inventors: Shigetoshi Watanabe, Sakado; Tomomi Hiura, Kawagoe; Minoru Nakano, Hino; Akira Shinmei, Higashi-Matsuyama, all of Japan

[73] Assignee: Toko, Inc., Tokyo, Japan

[21] Appl. No.: 983,682

[22] Filed: Dec. 1, 1992

[30] Foreign Application Priority Data

Dec. 10, 1991 [JP] Japan ..... 3-350063
Oct. 12, 1992 [JP] Japan ..... 4-299232
Oct. 16, 1992 [JP] Japan ..... 4-304887

[51] Int. Cl.[5] ..... H01F 15/10; H01F 27/30

[52] U.S. Cl. ..... 336/178; 336/83; 336/192; 336/198; 336/205

[58] Field of Search ..... 336/205, 198, 208, 83, 336/178, 96, 192

[56] References Cited

U.S. PATENT DOCUMENTS

| | | | |
|---|---|---|---|
| 2,355,477 | 8/1944 | Stahl | 336/198 |
| 2,876,425 | 3/1959 | Hampel | 336/208 |
| 3,346,828 | 10/1967 | Buschman | 336/205 |
| 3,717,833 | 2/1973 | Kubota et al. | 336/83 |
| 3,859,614 | 1/1975 | Reitnmaier | 336/83 |
| 4,549,158 | 10/1985 | Mitsui et al. | 336/83 |

FOREIGN PATENT DOCUMENTS

| | | | |
|---|---|---|---|
| 2431837 | 1/1976 | Fed. Rep. of Germany | 336/83 |
| 2431853 | 1/1976 | Fed. Rep. of Germany | 336/83 |
| 1904757 | 12/1978 | Fed. Rep. of Germany . | |
| 3612209 | 10/1987 | Fed. Rep. of Germany . | |
| 3735683 | 5/1989 | Fed. Rep. of Germany . | |
| 318551 | 8/1934 | Italy | 336/83 |
| 460941 | 10/1968 | Switzerland . | |
| 1407501 | 7/1975 | United Kingdom | 336/83 |

*Primary Examiner*—Thomas J. Kozma
*Attorney, Agent, or Firm*—Frishauf, Holtz, Goodman & Woodward

[57] ABSTRACT

A small and thin step-up transformer suitable for use in an inverter or the like includes: a bobbin formed of an insulating material having a cylindrical winding shaft; a primary winding wound on said winding shaft; and a secondary winding wound in alignment in multi-layers from the inner side to the outer side thereof; and wherein the primary winding and the secondary winding are separated from each other at a portion of the bobbin to be arranged side by side in the central axial direction of the winding shaft and are electromagnetically coupled to each other.

1 Claim, 7 Drawing Sheets

STEP-UP TRANSFORMER

BACKGROUND OF THE INVENTION

1. Field of the Invention

This invention relates to a small and thin step-up transformer suitable for use in an inverter for lighting a cold-cathode tube illuminating the back side of a liquid crystal display or the like.

2. Description of the Related Art

FIG. 12 shows the construction of a conventional step-up transformer for inverters. A primary, low-voltage-side winding L1 and a secondary, high-voltage-side winding L2 are wound on a hollow bobbin 2 having a plurality of flanges 1 in such a way as to be separated from each other by the flanges 1. The secondary winding L2, in which high voltage is generated, is wound in a plurality of stages due to the flanges 1 so as to reduce the difference in electrical potential between the adjacent wire sections, thereby preventing dielectric breakdown. Inserted into bore 3 of the bobbin 2 are central feet 6 and 7 of two E-shaped cores 4 and 5, which abut each other and are secured in position in this condition. The bobbin 2 and the cores 4 and 5 are fixed to an insulating base (not shown) having terminals embedded therein.

A transformer of this type must be formed thin so that it can be arranged in a narrow space in a liquid crystal display device. As a result, the cross section of the bore 3 of the bobbin 2 needs to be a flat, rectangular configuration, so that the winding length is getting longer as compared with bore 3 being not flat like a square or a circle, resulting in an increase in conductor resistance and deterioration in efficiency. In such a conventional rectangular transformer, 5 mm is the limit in the reduction in thickness because of the base attached from below to the bobbin and cores. A further reduction in thickness and a further increase in width will result in an excessive increase in copper loss. Further, since the secondary winding L2 has to be wound in a plurality of stages, the winding operation is rather complicated and the volume of the entire transformer is increased.

SUMMARY OF THE INVENTION

It is an object of the present invention to provide a step-up transformer which may be constructed into a low-height form with smaller copper loss and higher efficiency and at the same time has a high withstand voltage.

A step-up transformer of the present invention comprises: a bobbin formed of an insulating material having a cylindrical winding shaft; a primary winding wound on the winding shaft; and a secondary winding wound in alignment in multi-layers from the inner side to the outer side thereof and is characterized in that the primary winding and the secondary winding are separated from each other at a portion of the bobbin to be arranged side by side in the central axial direction of the winding shaft and are electromagnetically coupled to each other.

DESCRIPTION OF THE PREFERRED EMBODIMENT

Figure 1:
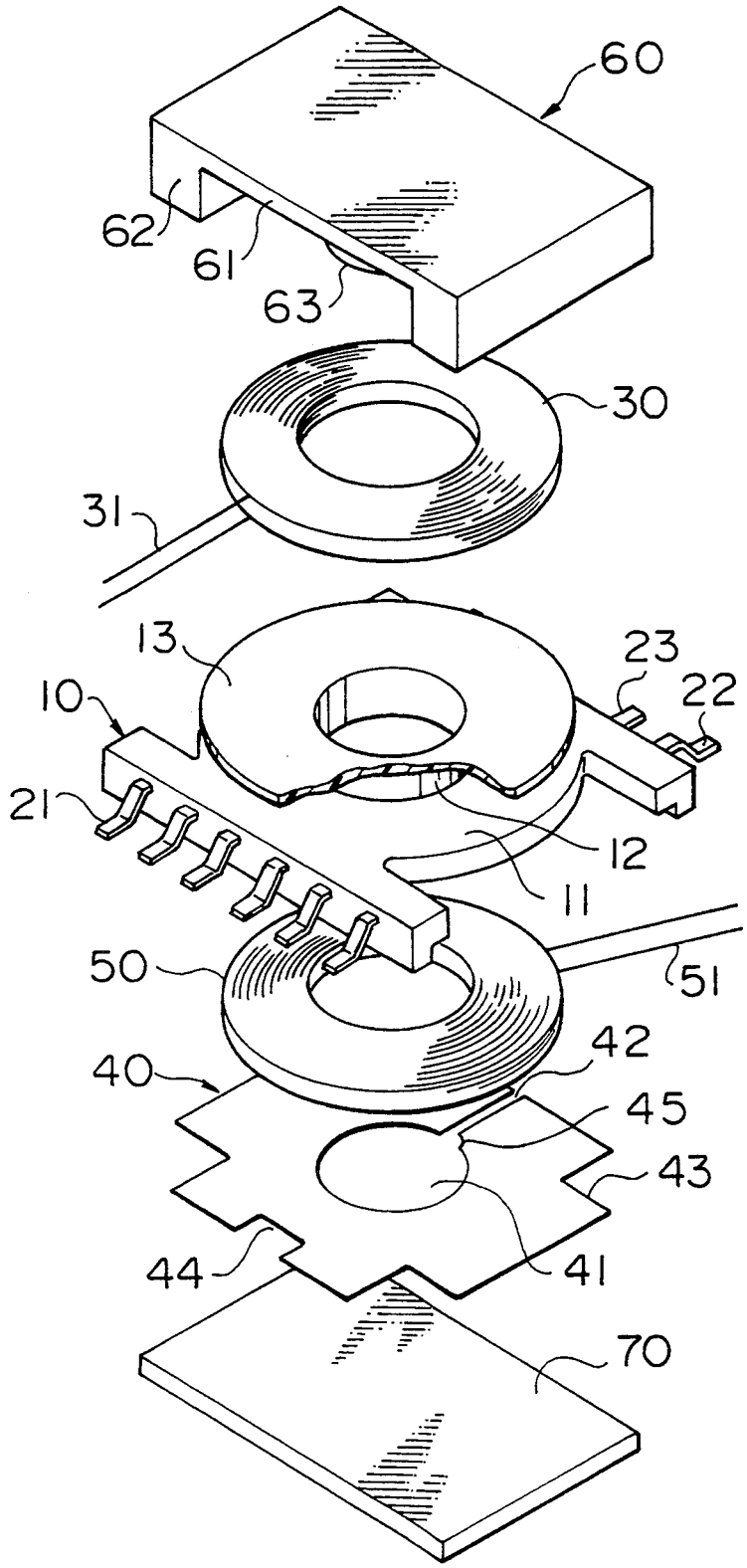
FIG. 1 is an exploded perspective view showing an embodiment of a transformer of the present invention with a portion thereof being removed.
Figure 2:
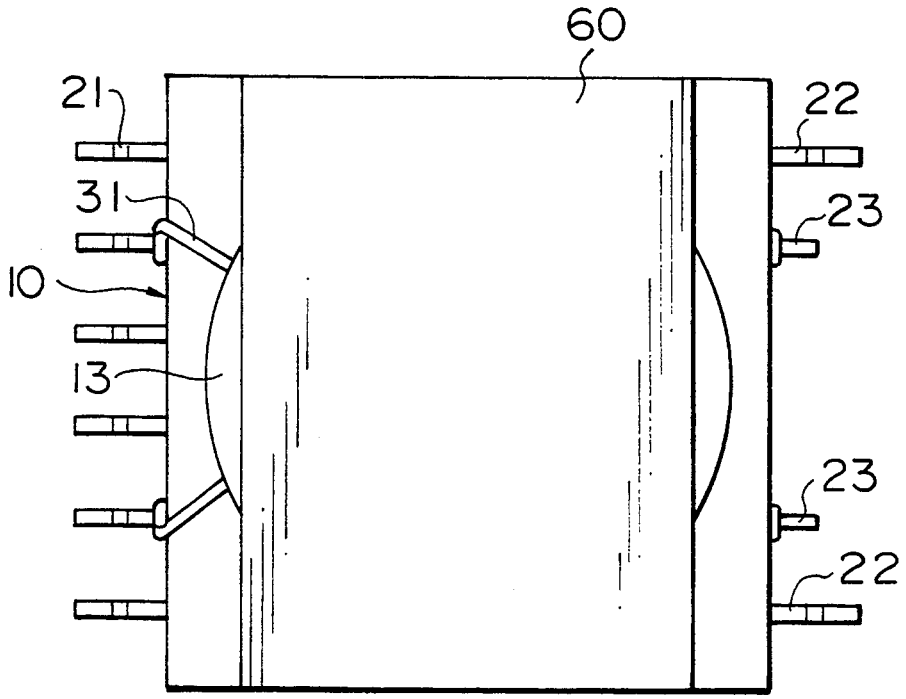
FIG. 2 is a top view of the same transformer.
Figure 3:
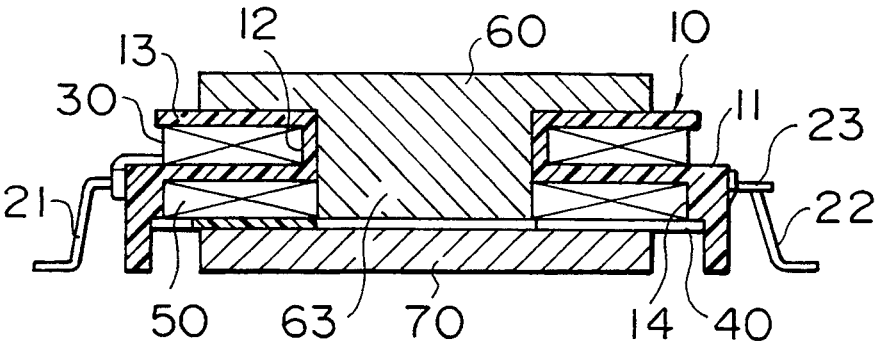
FIG. 3 is a front sectional view of the same transformer.
Figure 4:
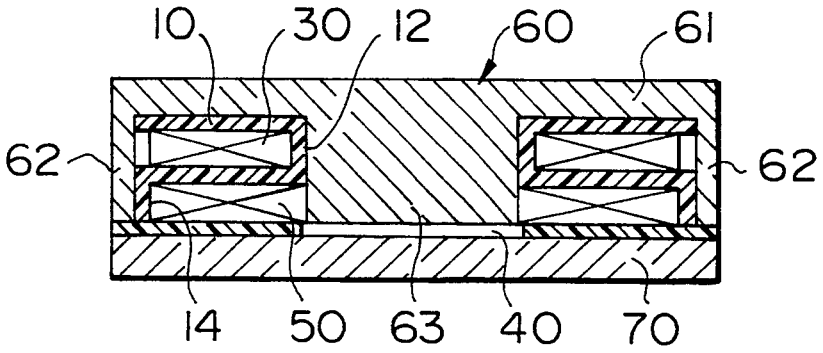
FIG. 4 is a side sectional view of the same transformer.

FIGS. 1 to 4 show an embodiment of the step-up transformer of this invention. FIG. 1 is an exploded perspective view, FIG. 2 is a plan view, FIG. 3 is a front sectional view, and FIG. 4 is a side sectional view.

A bobbin 10 made of plastic includes a base section 11 having a plurality of terminals 21, 22 and 23 embedded in two opposed side surfaces thereof; and a cylindrical winding shaft 12 protruding upwards from the center of the base section 11. Provided at the upper end of the winding shaft 12 is a flange 13. The terminals 22 and the shorter terminals 23, provided on one side of the bobbin 10, are divided into terminals for connecting the lead wires of a secondary winding 50 and terminals for external connection. That is, each terminal 22 and each shorter terminal 23 form a pair of terminals joined together inside the base section 11.

Figure 8:
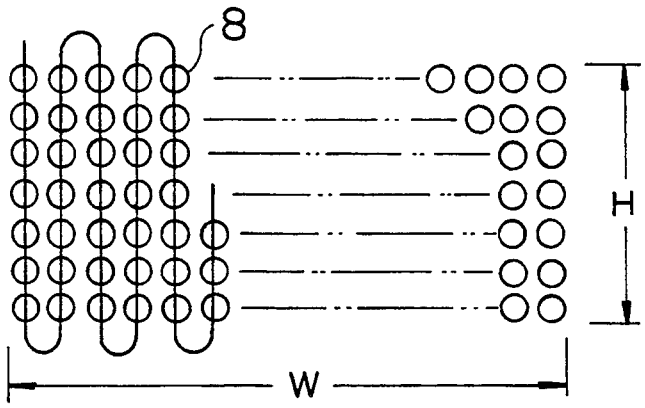
FIG. 8 is a view explanatory of the cross section of one side of a winding wound in alignment in multi-layers.

As shown in FIG. 3 and FIG. 4, a primary winding 30 at the low-voltage side is wound on the winding shaft 12 of the bobbin 10 and a secondary winding 50 at the high-voltage side is mounted inside a concave portion 14 provided on the lower surface of the base 11. The secondary winding 50 positioned underneath the base 11 is electromagnetically coupled via the base 11 to the opposing primary winding 30. The secondary winding 50 is firmly wound as shown in FIG. 1 in the state where a wire material 8 is wound as shown in FIG. 8 in alignment in multi-layers from the inner side to the outer side thereof. Such secondary winding 50 may be obtained by using the so-called self-fusing wire having such as thermoplastic varnish or the like on the outside of a copper wire which is coated for example with polyurethane, and such wire material is heated or it may be wound in alignment in multi-layers while applying a solvent thereon and then cooled or dried.

Numerals 60, 70 respectively denote a core consisting of a magnetic material. The pair of nonconductive magnetic material cores 60, 70 form a closed magnetic circuit as they are forced toward each other in a manner sandwiching the bobbin 10 from the upper and lower sides thereof. As is apparent from FIG. 4, the upper side core 60 is formed to have an E-shaped cross section having a flat plate portion 61, outside legs 62 formed integrally therewith at the both ends thereof and a cylindrical center leg 63 integrally formed at the center of the flat plate portion 61, the center leg 63 being inserted into the hollow portion of the winding shaft 12. On the other hand, the core 70 attached to the lower side of the bobbin 10 is formed into the shape of a flat plate.

As shown in FIG. 3 and FIG. 4, a thin sheet 40 formed of an insulating material such as polyimide is inserted between the core 60 and the core 70 so that a magnetic saturation is difficult to occur. The sheet 40 is formed, as shown in FIG. 1, with a through hole 41 which is slightly larger than the cross sectional area of the center leg 63 of the core 60 and a slit 42 which extends from one side surface thereof to the through hole 41. At the end portion of the slit 42 toward the through hole 41, a notch 45 is formed to increase the width thereof. Further, notches 43 are formed on the four corners of the sheet 40 so that the two cores 60, 70 may be bonded to each other at the positions of the four corners of the sheet 40, and a notch 44 is provided at the one side surface thereof so that an insulating coagulant such as varnish may be charged into the interior of a concave portion 14 of the bobbin 10 to which the secondary winding 50 is attached.

A lead wire 31 of the primary winding 30 is as shown in FIG. 2 connected over the base portion 11 to a terminal 21 embedded on one side surface of the bobbin 10. In some cases, in addition to the primary winding 30, such as a winding for feedback oscillation may be wound together on the winding shaft 12, and a tap may be brought out at some midway point thereof. In such a case, four to six lead wires are to be connected to the respective terminals 21.

Figure 5:
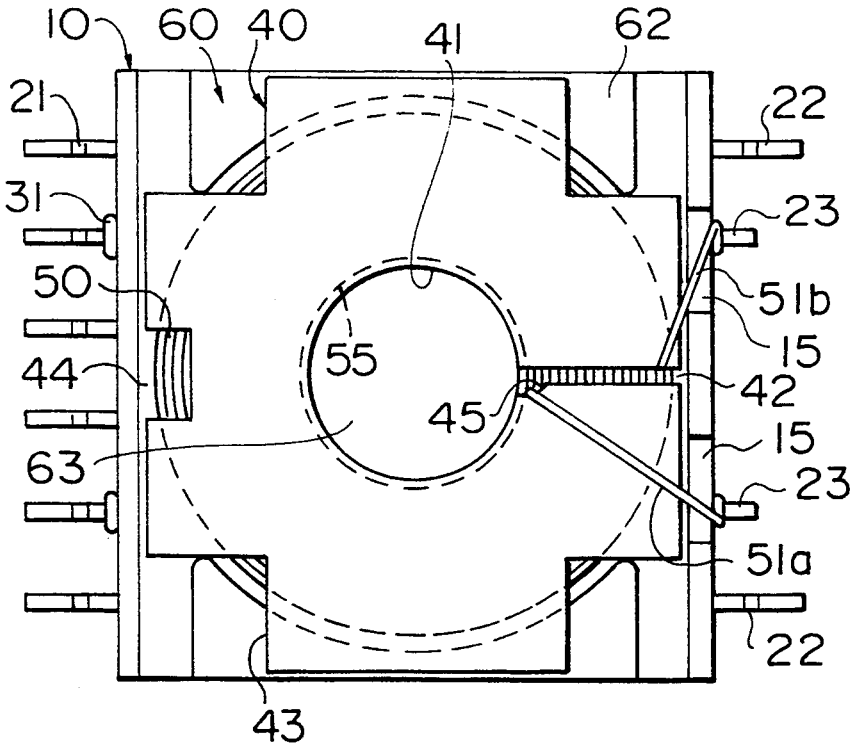
FIG. 5 is a bottom view of the same transformer with the lower side core being removed therefrom.

In the secondary winding 50, the potential difference between a lead wire 51*a* at the starting side of winding and another portion becomes larger as gets closer to the winding end portion at the outer side thereof. Thus, in order not to cause a dielectric breakdown between the lead wire 51*a* at the starting side of winding and a portion of the secondary winding 50 with a large potential difference, the lead wire 51*a* at the starting side of winding is, as shown in FIG. 5, brought out from the notch 45 at the inner part of the slit 42 and it passes through the underneath of the sheet 40 and then is connected to the terminal 23 through a groove 15 provided on the lower surface of the bobbin 10. Further, a lead wire 51*b* at the ending side of winding is brought out from the slit 42 to be connected to another terminal 23.

Figure 6:
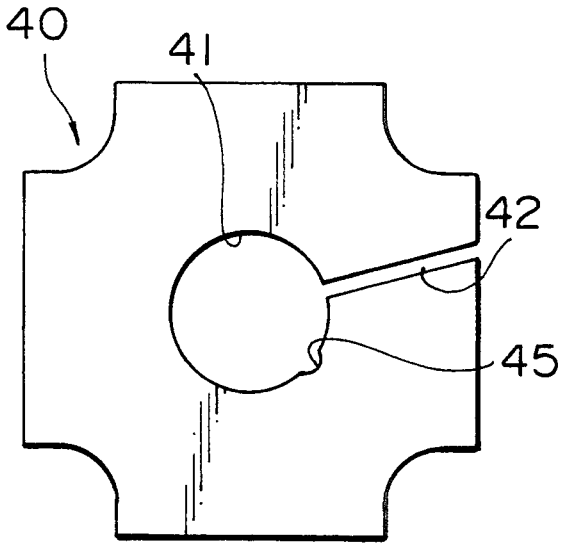
FIG. 6 is a top view showing a second embodiment of the sheet.

FIG. 6 shows a modification of sheet 40, where a notch 45 is provided on the periphery of the through hole 41 at a position separated from the slit 42. In this manner, the creeping distance between the lead wire 51*a* and the portion with large potential difference of the secondary winding 50 becomes greater to further improve the withstand voltage thereof.

As described above, the secondary winding 50 is firmly wound by previously winding it in alignment at some other place. When the through hole 41 and the slit 42 are provided on the sheet 40, the slit 42 may be opened before taking out the secondary winding 50 from the winding shaft of a winding machine to also attach the sheet 40 to the winding shaft from the side thereof, thereby they may be adhered and fixed to each other after guiding the lead wire 51 through the notch 45 and slit 42. There is thus an advantage that the assembling process becomes easier.

Figure 7:
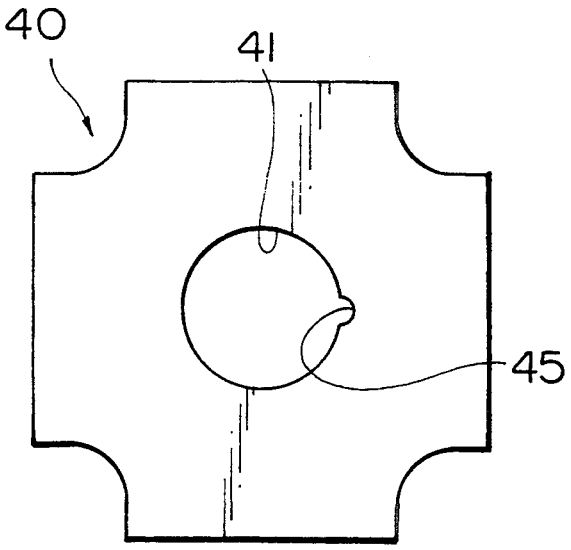
FIG. 7 is a top view showing a third embodiment of the sheet.

FIG. 7 shows a further modification of the sheet 40, where a slit is omitted and only the notch 45 is provided on the periphery of the through hole 41. In this case, it is advantageous from the viewpoint of the withstand voltage, though it cannot be attached to the winding shaft of a winding machine from the side thereof unlike the case of the sheet 40 with a slit 42.

While it is not always necessary to provide the through hole 41 on the sheet 40, since the sheet 40 is able to move in an up and down direction in the small gap between the secondary winding 50 and the core 70 if the through hole 41 which is slightly larger in area than the center leg 63 is provided, there is an advantage that the lead wire 51 may be passed through without any difficulty under the sheet 40. In any of these cases, it suffices to provide the notch 45 of the sheet 40 in the vicinity of the position opposing an inner peripheral surface 55 (FIG. 5) of the secondary winding 50.

When, as shown in FIG. 8, the wire material 8 is wound in the direction of the arrow in a number of layers, the winding-start section of each layer is positioned adjacent to the winding-end section of the next layer. However, even if, in the above-described transformer construction, the voltage applied to both ends of the secondary winding 50 is 2 kV, the voltage applied across them is 2000/20 V, that is, 100 V, when the secondary winding 50 is wound, for example, in 40 layers, so that, as in the conventional example in which the secondary winding L2 is wound in a plurality of stages due to the flanges, the electrical potential between the adjacent wire-material sections is low, thus preventing dielectric breakdown. In some step-up transformers for inverters, the voltage on the secondary-winding side may be as small as 1000 V or less. To avoid dielectric breakdown, however, it is advantageous to make the height H of the secondary winding 50 as small as possible and the winding width W as large as possible. In any case, it is desirable that the winding width W of the secondary winding 50 be larger than the height H.

It is also possible for the pair of cores to be E-shaped cores of the same configuration, with their central feet abutting each other within the spool 12 of the bobbin 10.

Next, a condition for obtaining a desired inductance L0 and saturation current I0 in an inductance element will be considered. Assuming that the number of turns of the coil is N and the magnetic reluctance thereof is R, the inductance can be expressed as $N^2/R$, so that $$R \leqq N^2/L0 \quad (1)$$

Assuming the cross-sectional area of the magnetic circuit having a uniform cross-sectional area is S, and the saturation magnetic flux density thereof is Bm, the saturation current can be expressed as BmSR/N, so that $$R \geqq I0N/BmS \quad (2)$$

That is, in terms of the inductance L0, it is necessary for the magnetic reluctance R to be small, and, in terms of the saturation current I0, it necessary for the magnetic reluctance R to be large.

Figure 9:
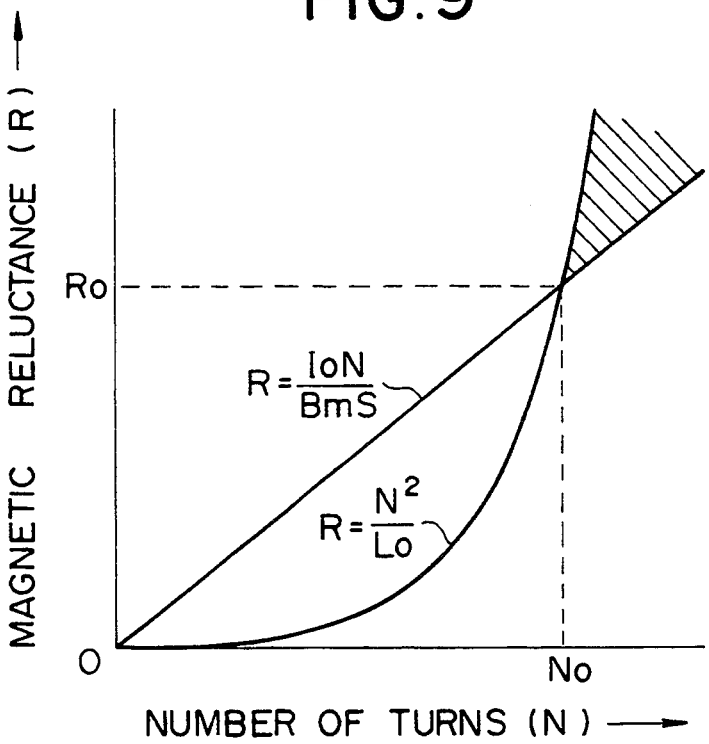
FIG. 9 is a graph showing the relation between number of turns and magnetic reluctance.

The relationship between formulas (1) and (2) is plotted in FIG. 9, in which the horizontal axis represents the number of turns N and the vertical axis represents the magnetic reluctance R. In the diagram, the shaded area represents the range satisfying formulas (1) and (2). As shown in FIG. 9, the minimum number of turns and the minimum magnetic reluctance satisfying the required characteristics are N0 and R0, respectively. Assuming that the average length of the magnetic path is 1 and the magnetic permeability of the cores is $\mu$, the magnetic reluctance R can be generally expressed as: $R=1/\mu S$, so that, providing that the cross-sectional area S is constant, it may be assumed that the magnetic reluctance R is proportional to the volume of the magnetic body. Accordingly, it may be assumed that N0 and R0 satisfy the required characteristics, and constitute the solutions minimizing the volume of the inductance element. That is, the optimal solutions of the number of turns and the magnetic reluctance are as follows:

$$N0 = L0I0/BmS \quad (3)$$

$$R0 = L0I0^2/(BmS)^2 \quad (4)$$

Figure 12:
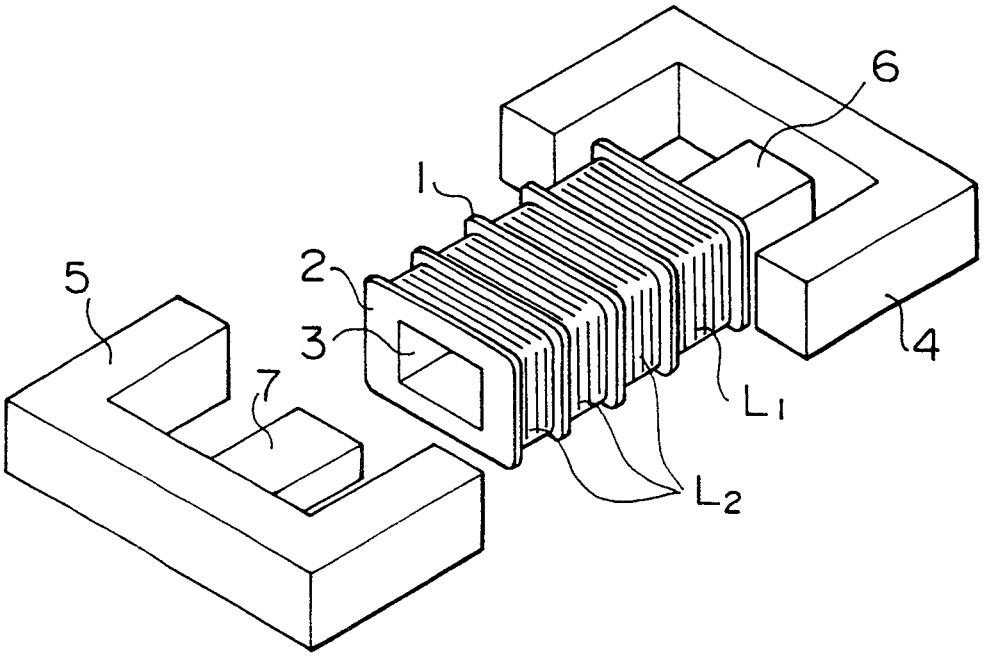
FIG. 12 ( PRIOR ART )
FIG. 12 is an exploded perspective view of a conventional transformer.

Next, with respect to a transformer as shown in FIG. 12 of which a cross section of the center leg 63 of the core to be inserted into the center of the primary winding and the secondary winding is rectangular-shaped and a round-shaped transformer as shown in FIG. 3, the specification of the two transformers is determined as follows to compare their respective characteristics.

primary inductance: 200 μH or more
primary-winding saturation current: 1A or more
primary/secondary turns ratio: 1:50
diameter of the winding material of the primary winding: 0.25 mmΦ
diameter of the winding material of the secondary winding: 0.07 mmΦ
winding withstand voltage: 100 VP-P or less Assuming that the relative magnetic permeability μr of the magnetic body is 3000, that the saturation magnetic flux density Bm is 0.3 T, and that the minimum sectional area S of the magnetic circuit is 15 mm² N0 and R0 can be obtained from equations (3) and (4) as follows:

$$\begin{aligned} NO &= LOIO/BmS \\ &= 200 \times 10^{-6} \times 1/(0.3 \times 15 \times 10^{-6}) \\ &= 45 \text{ (turns)} \\ RO &= LOIO^2/(BmS)^2 \\ &= 200 \times 10^{-6} \times 1^2/(0.3 \times 15 \times 10^{-6})^2 \\ &= 9.88 \text{ (AT/Wb)} \end{aligned}$$

Thus, since the primary winding has 45 turns, and the turns ratio is 1:50, the secondary winding has 2250 turns. By designating the rectangular and the round transformer under the above conditions, the following results were obtained.

TABLE 1

Comparison of Rectangular and Round Transformers

| Item | Rectangular Transformer | Round Transformer |
|---|---|---|
| Volume | 2.5 cc | 2.1 cc (84%) |
| Primary-winding length | 207 cm | 103 cm (50%) |
| Secondary-winding length | 104 m | 77 m (74%) |
| Separate winding | necessary | unnecessary |
| Maximum thickness | 8 mm | 5.3 mm |

The percentage values in the parentheses represent relative values when the corresponding values of the rectangular transformer are 100.

As is apparent from Table 1, a round-shaped transformer is advantageous from the viewpoint of copper loss and volume when an identical performance is to be achieved with the same magnetic material. This is particularly true in the case of a transformer used as an inverter transformer, in which a resonance current having a large amplitude of several tens of kilohertz flows through the primary winding, so that the reduced amount of copper in the primary winding greatly contributes to improving the transformation efficiency of the transformer.

Figure 10:
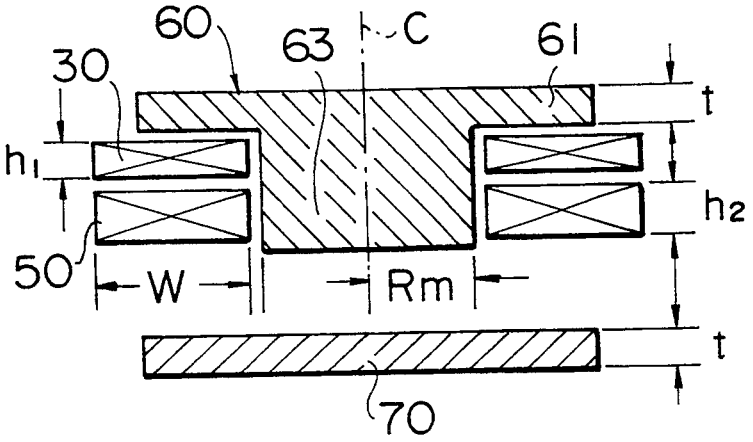
FIG. 10 is a front sectional view showing the dimensional relationship between the core and the winding.

FIG. 10 is a schematic view showing in a cross section only the core 60 and the core 70, the primary winding 30 and the secondary winding 50. It should be noted that, since the actual thickness of the winding shaft 12 of the bobbin is small to the extent that it may be ignored in relation to the winding width of the primary winding 30 and the winding width of the primary winding 30 and the winding width of the secondary winding 50 may be considered as substantially the same, the respective winding width of these two windings in this figure is represented by an identical dimension W.

In a transformer as shown in FIG. 3, a condition will be obtained which minimizes the sum of the areas of the cross sections of the center leg 63 and the primary and secondary windings 30 and 50 as taken along a plane perpendicular to the central axis C of the center leg 63, i.e., a condition for minimizing the radius Rm of the center leg 63 and the sum of the winding widths W of the primary and secondary windings shown in FIG. 10.

Now, assuming that: the radius of the center leg 63 is Rm; the turn ratio of the primary winding and the secondary winding is 1:n; the thickness of the flat portion 61 in the core 60 and of the core 70 is t; the dimension of the height of the primary winding 30 is h1; the dimension of the height of the secondary winding 50 is h2; and the respective diameters of the wire material of the primary winding and the secondary winding are d1 and d2; the number of turns per layer of the primary winding 30 will be h1/d1 and the number of turns per layer of the secondary winding 50 will be h2/d2. Thus, while the respective number of layers to be placed one upon another is N0 d1/h1 for the primary side and nN0 d2/h2 for the secondary side, the winding width of the primary winding 30 and that of the secondary winding 50 are equalized by setting the ratio of the heights h2, h1 of the secondary winding 50 and the primary winding 30 as:

$$h2/h1 = nd2^2/d1^2 \quad (5)$$

Such winding width W may be represented by the elements of the primary winding 30 as:

$$W = N0d1^2/h1 \quad (6)$$

In the following, a "joint section" will be considered which is that portion of the flat section 61 of the core which is immediately under the center leg 63 and which is defined or intersected by a downward extension of the center leg 63, i.e., the cylindrical portion of the flat section 61 having the same diameter as the center leg 63 and the same thickness t as the flat section 61. In a small, low-type transformer, the minimum sectional area S of the magnetic circuit is generally restricted by this joint section of the core. Since the area of this core joint section is not larger than the cross-sectional area of the center leg 63, $$2\pi Rmt \leqq \pi Rm^2$$

Therefore, $$Rm \geqq 2t \quad (7)$$

The area S of the joint section can be expressed as:

$$S=2\pi Rmt \quad (8)$$

Without considering the distance between the primary and secondary windings, the total cross sectional area $\Sigma s$, including sectional areas of the center leg 63 and the winding sections, can be expressed as:

$$\Sigma s=\pi(Rm+W)^2 \quad (9)$$

The total cross-sectional area can be minimized by minimizing the parenthesized portion of equation (9), which portion will be referred to as P. Thus, $$P=Rm+W \quad (10)$$

Substituting the W of equations (6) into equation (10), the following is obtained:

$$P=Rm+d1^2/h1+N0$$

Thus, from equation (3), $$P=Rm+d1^2/h1+(L0I0/BmS)$$

Substituting the S of equation (8) into the above, $$P=Rm+[d1^2L0I0/2\pi Bmh1t]\times 1/Rm$$

Assuming that $K=d1^2L0I0/2\pi Bmht$, $$P=Rm+K/Rm \quad (11)$$

$$dP/dRm=1-K/Rm^2 \quad (12)$$

Accordingly, the value Rm0 of the radius Rm of the center leg 63 which minimizes P can be expressed as follows:

$$dP/dRm=0,$$

$$Rm0=K^{\frac{1}{2}} \quad (13)$$

From equations (11) and (12), the minimum value of P is expressed as follows:

$$P=K^{\frac{1}{2}}+K/K^{\frac{1}{2}}=2K^{\frac{1}{2}} \quad (14)$$

Thus, P is minimum when $Rm=K^{\frac{1}{2}}$ and $W=K^{\frac{1}{2}}$, that is, when Rm=W Assuming that the value of $W=K^{\frac{1}{2}}$ is constant and that Rm is X times this value, $$Rm=X\cdot K^{\frac{1}{2}}$$

Substituting this into equation (11), $$P=X\cdot K^{\frac{1}{2}}+K/X\cdot K^{\frac{1}{2}}=X\cdot K^{\frac{1}{2}}+K^{\frac{1}{2}}/X$$

Therefore, $$P=K^{\frac{1}{2}}(X+1/X) \quad (15)$$

Figure 11:
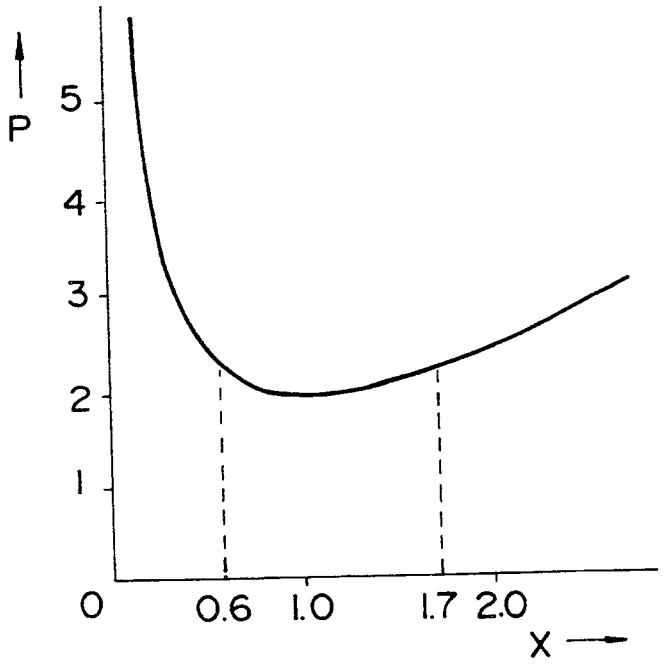
FIG. 11 is a view showing the relation between X and P.

The relationship between P and X is plotted in FIG. 11. P is minimum when X=1, and increases relative to X, along the curve of X+1/X. When the value of P applicable for practical use ranges from the minimum value thereof to plus 15%, the value of X, that is, the ratio of Rm to W ranges from 0.6 to 1.7.

According to the present invention, a step-up transformer may be obtained, which is not only with relatively lower height and less bottom area but also with smaller copper loss and higher efficiency as the length of the winding wire material is reduced. Further, since an insulating sheet to be inserted between a pair of cores to improve the magnetic characteristic thereof is utilized to insulate the lead wire at the winding start side of the secondary winding from the portion with a large potential difference, a dielectric breakdown may be effectively prevented as such effect is combined with the effect of the construction where the primary winding and the secondary winding are caused to oppose each other by way of a bobbin.

What is claimed is:

1. A step-up transformer comprising:

a bobbin including a base portion, formed of an insulating material, having terminals embedded on opposing two side surfaces thereof, and a cylindrical winding shaft protruding upward from substantially a center of said base portion;

a primary winding wound on said winding shaft, lead wires of which being connected to said terminals on one of said opposing two side surfaces of said base portion;

a secondary winding electromagnetically coupled to said primary winding, disposed downward from said base portion, wound in alignment in ring-like multi-layers, lead wires of which being connected to said terminals on another of said opposing two side surfaces of said base portion;

a first core formed of a magnetic material, having an E-shaped cross section including a cylindrical center leg, and said center leg being inserted into both openings of said winding shaft and said secondary winding from an upper side of said bobbin;

a second core having a flat plate formed of a magnetic material, attached to a lower side of said bobbin facing against said first core; and an insulating sheet provided between said first and second cores and wherein one of said lead wires of said secondary winding goes through between said sheet and said second core.

* * * * *